US009219328B2

(12) United States Patent
Yamada

(10) Patent No.: US 9,219,328 B2
(45) Date of Patent: Dec. 22, 2015

(54) TERMINAL BLOCK WITH PROTECTIVE COVER

(71) Applicant: Sumitomo Wiring Systems, Ltd., Yokkaichi (JP)

(72) Inventor: Hiroki Yamada, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/463,752

(22) Filed: Aug. 20, 2014

(65) Prior Publication Data

US 2015/0056852 A1 Feb. 26, 2015

(30) Foreign Application Priority Data

Aug. 23, 2013 (JP) ..... 2013-173217

(51) Int. Cl.

| | |
|---|---|
| ***H01R 13/60*** | (2006.01) |
| ***H01R 13/52*** | (2006.01) |
| *H01R 4/30* | (2006.01) |
| *H01R 9/24* | (2006.01) |
| *H01R 11/12* | (2006.01) |

(52) U.S. Cl.

CPC ..... *H01R 13/5213* (2013.01); *H01R 4/30* (2013.01); *H01R 9/24* (2013.01); *H01R 11/12* (2013.01)

(58) Field of Classification Search

CPC ..... H01R 13/5213; H01R 4/30; H01R 9/24; H01R 11/12

USPC ..... 439/528, 607.58, 607.57, 607.51, 439/607.44, 135, 718; 174/138 F

See application file for complete search history.

(56) References Cited

U.S. PATENT DOCUMENTS

| | | | | |
|---|---|---|---|---|
| 2,619,518 | A * | 11/1952 | Le Roy | 361/129 |
| 2,892,176 | A * | 6/1959 | James | 439/717 |
| 7,134,921 | B2 * | 11/2006 | Siracki et al. | 439/798 |
| 7,396,262 | B2 * | 7/2008 | Korczynski et al. | 439/723 |
| 7,939,754 | B2 * | 5/2011 | Richter et al. | 174/50 |
| 8,003,885 | B2 * | 8/2011 | Richter et al. | 174/50 |
| 8,298,019 | B2 * | 10/2012 | Russo et al. | 439/718 |
| 8,313,351 | B2 * | 11/2012 | Patel et al. | 439/709 |
| 8,727,818 | B2 * | 5/2014 | Kossak | 439/798 |
| 2003/0003811 | A1 * | 1/2003 | Chadbourne | 439/718 |
| 2006/0240717 | A1 * | 10/2006 | Chen | 439/718 |

FOREIGN PATENT DOCUMENTS

JP 2007-328966 12/2007

* cited by examiner

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

Terminal fittings (11, 12) are connected to a side surface side of a housing (24) of a terminal block (20). A protection cover (50) covers the side surface side of the housing (24) and includes an upper surface cover (51) for covering an upper surface (24T) of the housing (24). The upper surface cover (51) includes an upper surface proximate portion (51P) to be arranged proximate to the upper surface (24T) of the housing (24). A step is formed between an outer edge (51E) of the upper surface cover (51) and the housing (24), the upper surface proximate portion (51P) is rearward than the outer edge (51E) of the upper surface cover (51) and a clearance larger than the one between the upper surface proximate portion (51P) and the upper surface (24T) of the housing (24) is formed below the outer edge (51E) of the upper surface cover (51).

4 Claims, 11 Drawing Sheets

TERMINAL BLOCK WITH PROTECTIVE COVER

BACKGROUND OF THE INVENTION

1. Field of the Invention

The invention relates to a terminal block with a protection cover.

2. Description of the Related Art

Japanese Unexamined Patent Publication No. 2007-328966 discloses a terminal block with a protection cover. The terminal block is used with a terminal fitting that is fixed to an end of a wire. A bolt shaft projects on a surface of the terminal block and the bolt shaft is inserted through a round hole at a tip of the terminal fitting. A nut then is screw-fastened to the bolt shaft for electrically connecting the bolt shaft with the terminal fitting. The terminal fitting is accommodated in a resin case. The resin case includes a base configured to accommodate the tip of the terminal fitting therein and is arranged in contact with the surface of the terminal block. A protection cover is mounted on a front side of the base. The base includes a circular ring-shaped peripheral wall surrounding the outer periphery of the tip of the terminal fitting and the protection cover includes a circular ring-shaped peripheral wall that can fit externally onto the peripheral wall of the base. The electrically connected part of the terminal block and the terminal fitting is protected by externally fitting the peripheral wall of the protection cover onto the peripheral wall of the base and mounting the protection cover after the terminal fitting is connected electrically to the terminal block.

Liquid, such as water, may adhere to an outer surface of the protection cover and may reach a small clearance between the peripheral wall of the base and the peripheral wall of the protection cover that is fit externally onto the peripheral wall of the base. Hence, the liquid can penetrate to a back side of the clearance by a capillary phenomenon, and can reach the electrically connected part.

The invention was completed based on the above situation and aims to provide a terminal block with a protection cover capable of preventing the penetration of liquid through a small clearance between a protection cover and a terminal block.

SUMMARY OF THE INVENTION

The invention is directed to a terminal block with a protection cover. The terminal block is used with a terminal fitting that is fixed to an end of a wire and that is to be connected electrically by bolting. A protection cover is assembled with the terminal block and covers a part of the terminal block that is connected electrically with the terminal fitting. The terminal block includes a housing to which the terminal fitting is to be bolt-fastened. The housing holds a fastening member that is provided on a side surface side of the housing. The protection cover covers the side surface side of the housing. More particularly, the protection cover includes an upper surface cover portion for covering an upper surface of the housing and an upper surface proximate portion to be arranged proximate to the upper surface of the housing. A clearance that is larger than a clearance between the upper surface proximate portion and the upper surface of the housing is formed below an outer edge of the upper surface cover portion by forming a step between the outer edge of the upper surface cover portion and the housing.

According to such a configuration, liquid that flows along an upper surface of the upper surface cover portion of the protection cover and reaches the outer edge of that upper surface falls down without reaching the upper surface proximate portion. Thus, the liquid will not penetrate through a small clearance between the protection cover and the terminal block.

The protection cover may include a lower surface cover portion for covering a lower surface of the housing. The lower surface cover portion may include a lower surface proximate portion to be arranged proximate to the lower surface of the housing. A clearance larger than the clearance between the lower surface proximate portion and the lower surface of the housing may be formed below an outer edge of the lower surface of the housing by forming a step between the outer edge of the lower surface cover portion and the housing.

According to this configuration, liquid that flows along an outer surface of the housing and reaches the lower end of that outer surface falls down without reaching the lower surface proximate portion. Thus, the liquid will not penetrate through a small clearance between the protection cover and the terminal block.

A step formed by projecting an outer edge of the protection cover toward a side away from the housing would lead to an enlargement of the terminal block with the protection cover and would change the outer shape of the terminal block with the protection cover. Accordingly, the step may be formed by a recess on the housing. A step formed by a recess on the housing does not enlarge the housing or change the shape of the housing.

DETAILED DESCRIPTION OF THE PREFERRED EMBODIMENT

The letter T in the figures identifies an assembly that includes a terminal block 20 and a protection cover 50. First and second terminal fittings 11 and 12 are fixed to ends of wires 10 and are bolted to the terminal block 20. The terminal block 20 and the terminal fittings 11 and 12 may be connected to a device in a front or rear part of an unillustrated vehicle.

Figure 1:
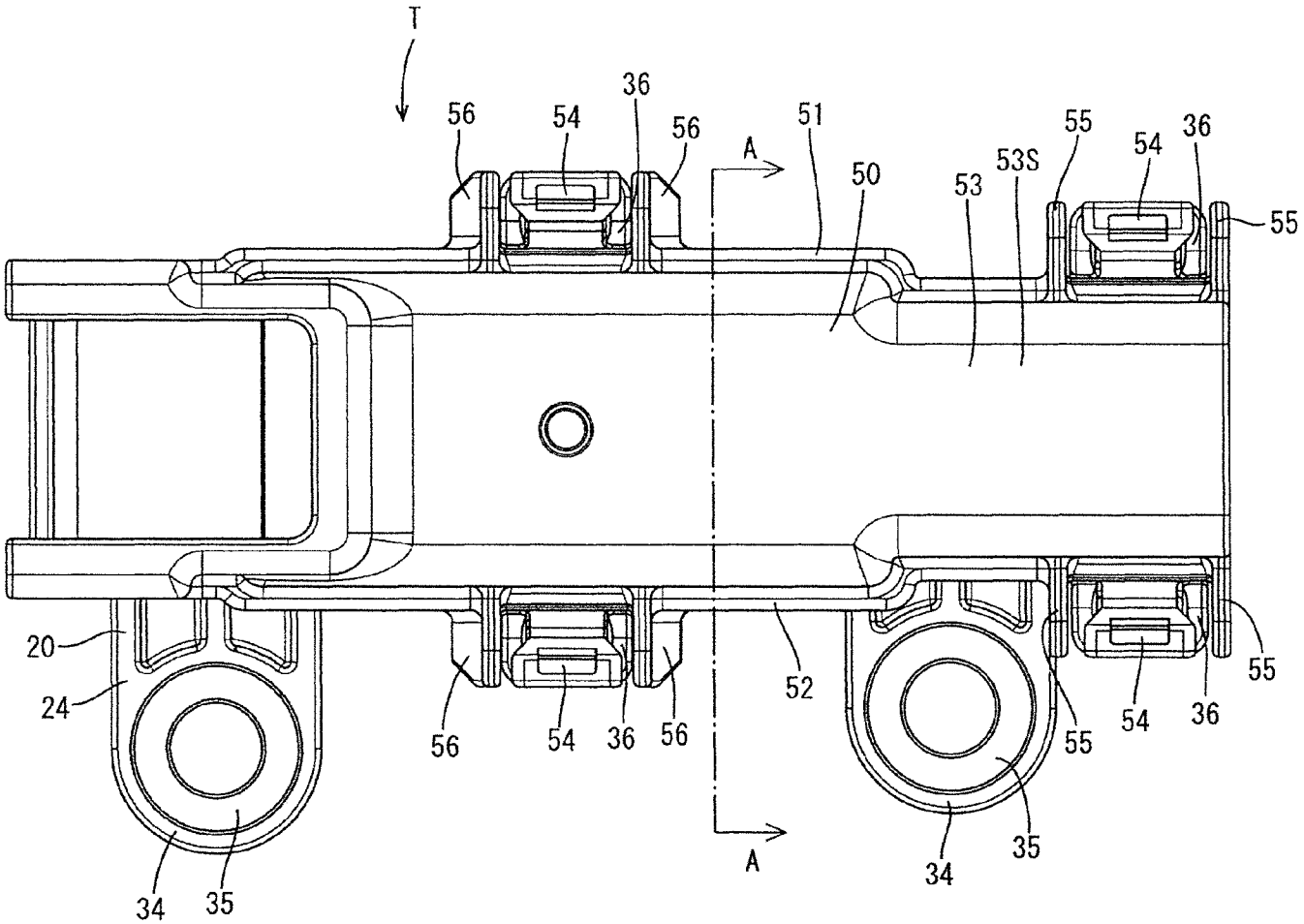
FIG. 1 is a front view of a terminal block with a protection cover according to an embodiment.
Figure 4:
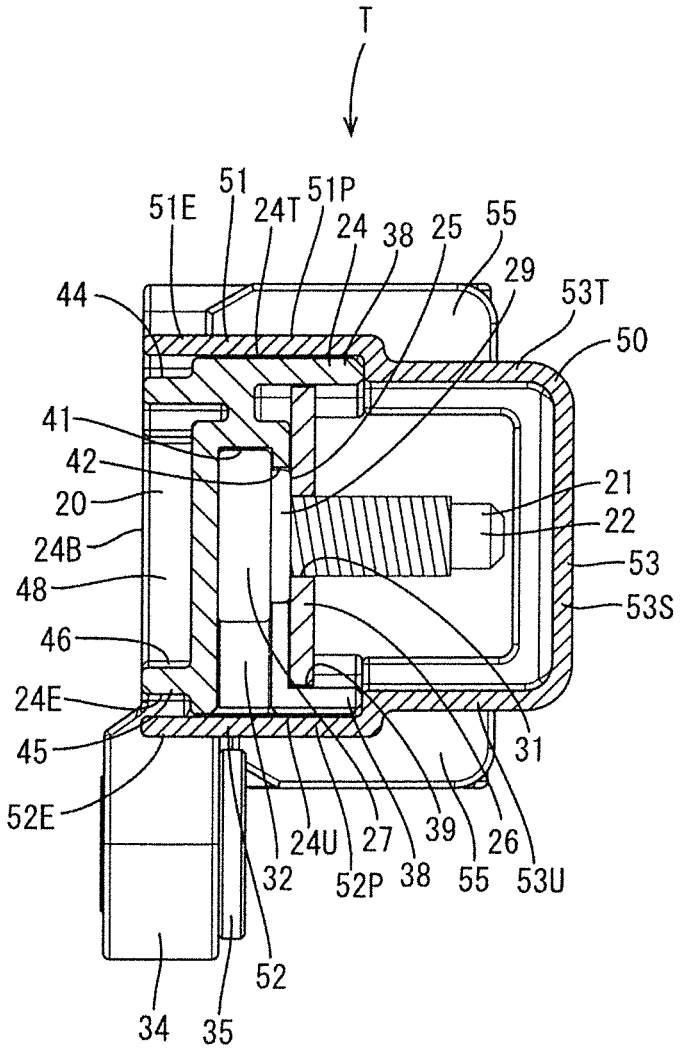
FIG. 4 is a section of the terminal block with the protection cover equivalent to a cross-section along A-A of FIG. 1.

As shown in FIG. 4, the terminal block 20 is mounted and fixed to a body of the vehicle by bolting mounting flanges 34 to the body in such a posture that the mounting flanges 34 are arranged on a lower side. In the following description, an upper side (upper side of FIG. 4) and a lower side in a state where the terminal block 20 is fixed to the body are referred to as upper and lower sides. A side on which the protection cover 50 is mounted (right side of FIG. 4) and an opposite side (left side of FIG. 4) are referred to as front and rear sides. Left and right sides in FIG. 1 are referred to as left and right sides.

The first and second terminal fittings 11, 12 are crimped respectively to cores 14 exposed by stripping insulation coatings 13 at end parts of the insulated wires 10. Each of the first and second terminal fittings 11, 12 is formed by press-working an electrically conductive metal flat plate and integrally includes a connecting portion 15 to be connected to the terminal block 20 and a crimping portion 16 to be crimped to the end part of the wire 10. The first terminal fitting 11 is so formed that the connecting portion 15 and the crimping portion 16 are substantially horizontal, whereas the second terminal fitting 12 is formed into an L shape so that the connecting portion 15 and the crimping portion 16 are substantially perpendicular to each other (see FIG. 8).

Figure 5:
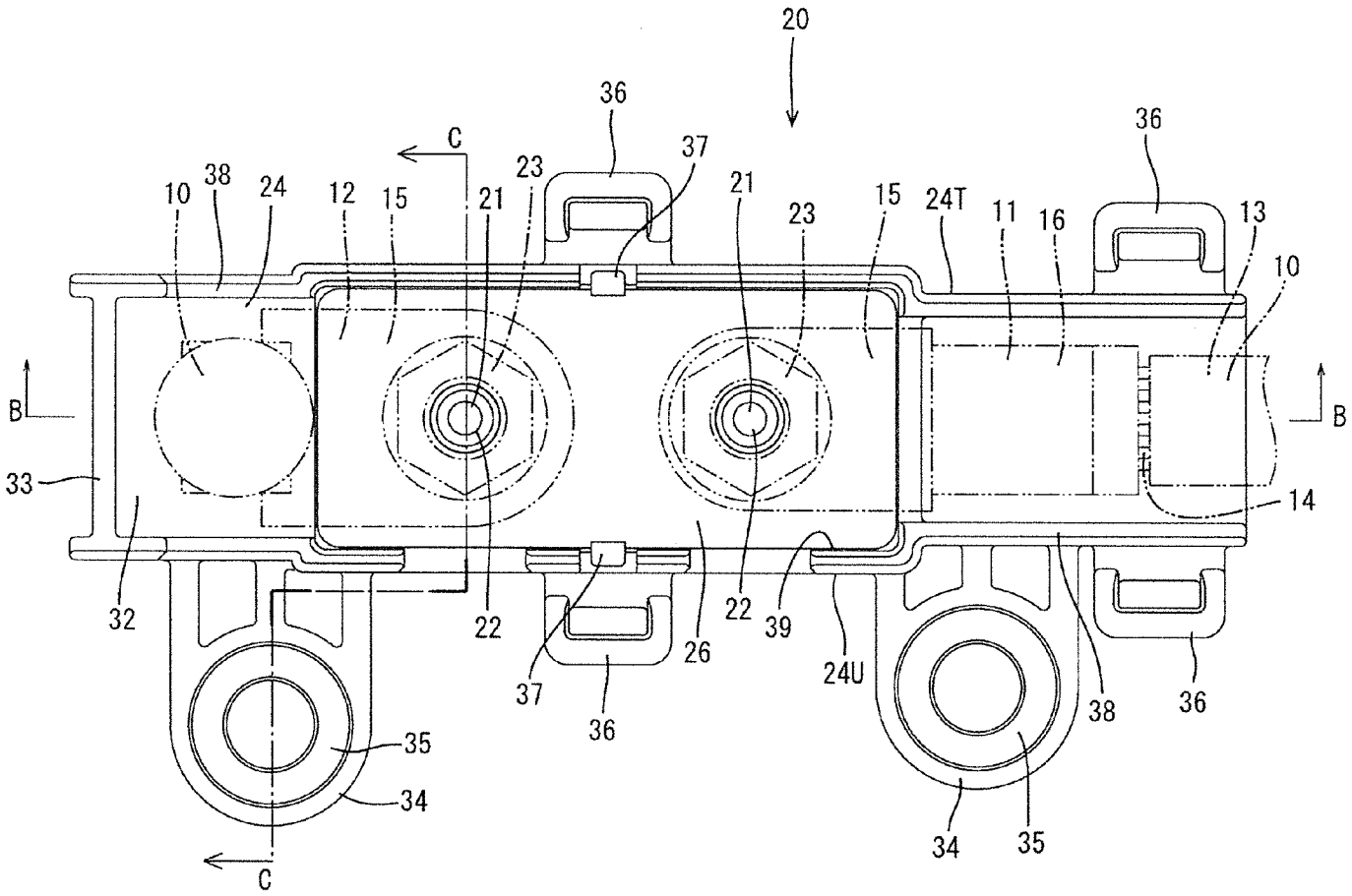
FIG. 5 is a front view of a terminal block.
Figure 8:
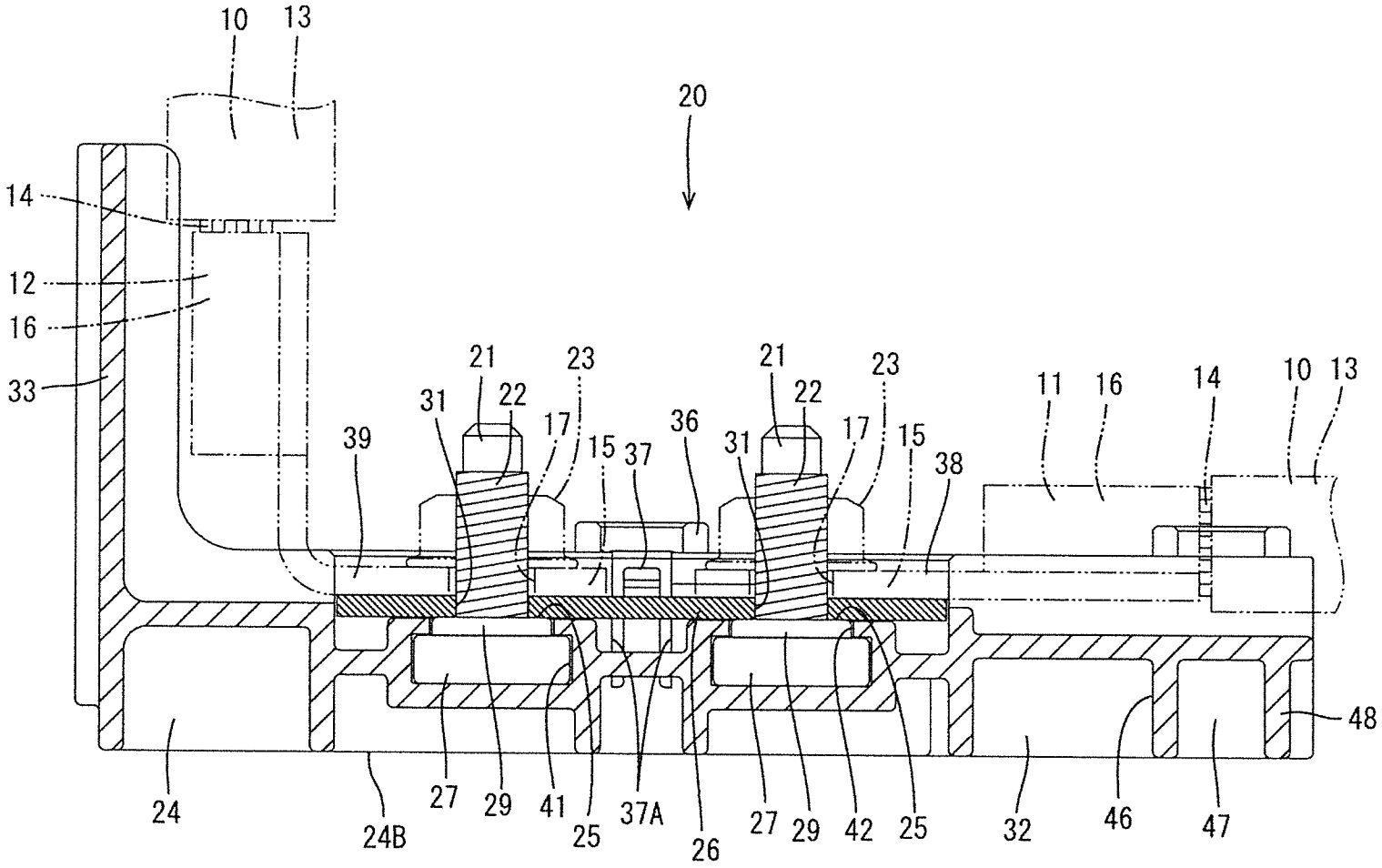
FIG. 8 is a section of the terminal block equivalent to a cross-section along B-B of FIG. 5.
Figure 9:
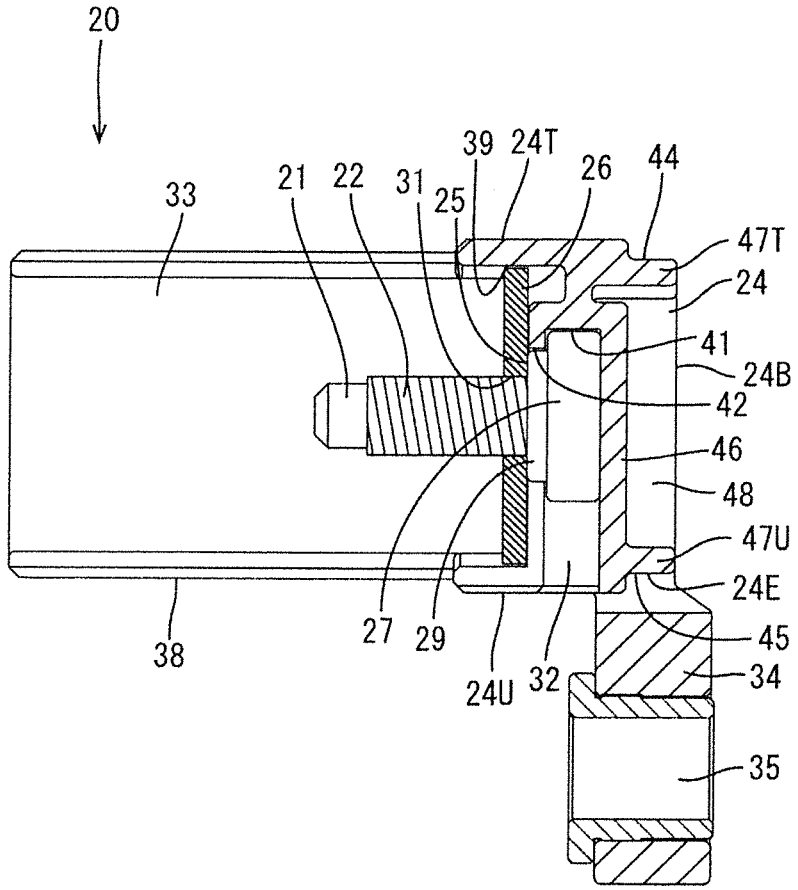
FIG. 9 is a section of the terminal block equivalent to a cross-section along C-C of FIG. 5.

The connecting portion 15 of each of the first and second terminal fittings 11, 12 is formed with one insertion hole 17 and a shaft 22 of a stud bolt 21 provided in a housing 24 of the terminal block 20 can be inserted therethrough, as shown in FIG. 8. As shown in FIG. 5, the connecting portion 15 of the first terminal fitting 11 is narrower than the second terminal fitting 12. The crimping portion 16 of each of the first and second terminal fittings 11, 12 includes two wire barrel pieces to be crimped to the exposed core 14. Note that the wire 10 is, for example, a thick wire whose core 14 has a cross-section of 30 mm2.

As shown in FIG. 8, the terminal block 20 includes the stud bolts 21 and nuts 23 made of metal, the housing 24 made of synthetic resin for holding the stud bolts 21 and a connecting plate 26 made of electrically conductive metal and to be placed on seating surfaces 25 of the stud bolts 21. The nuts 23 are hexagonal nuts.

Figure 10:
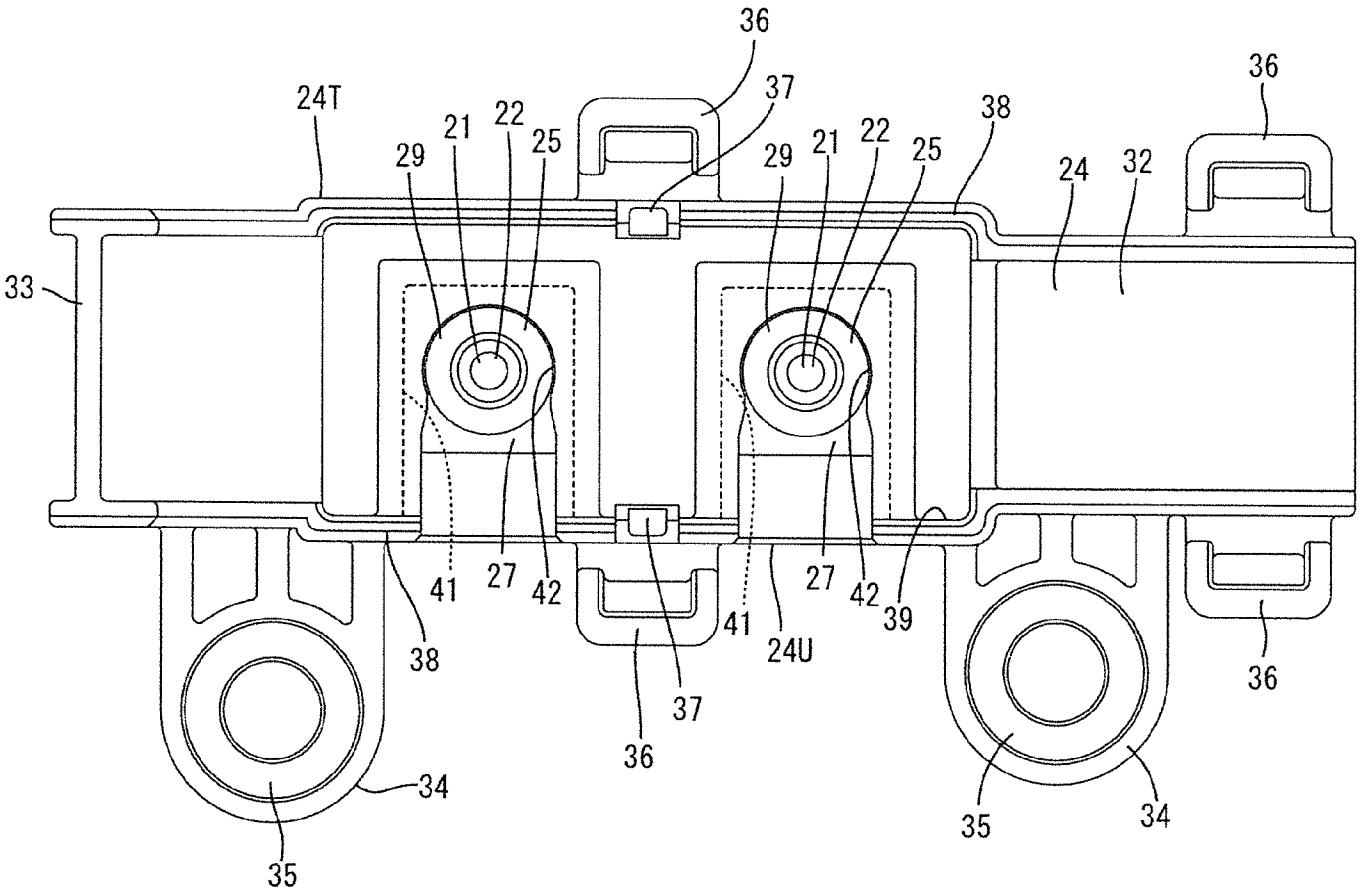
FIG. 10 is a front view of the terminal block before a connection plate is mounted.

The stud bolt 21 includes a head 27 in the form of a rectangular column and the shaft 22 extending substantially upright from the head 27 (see FIGS. 4 and 10). A surface of the head 27 from which the shaft 22 extends has a substantially circular fastening seat 29. The shaft 22 extends in the center of the fastening seat 29.

As shown in FIGS. 5 and 8, the connection plate 26 is a wide substantially rectangular plate, and has left and right through holes 31 dimensioned to enable the passage of the shafts 22 of the stud bolts 21.

Figure 6:
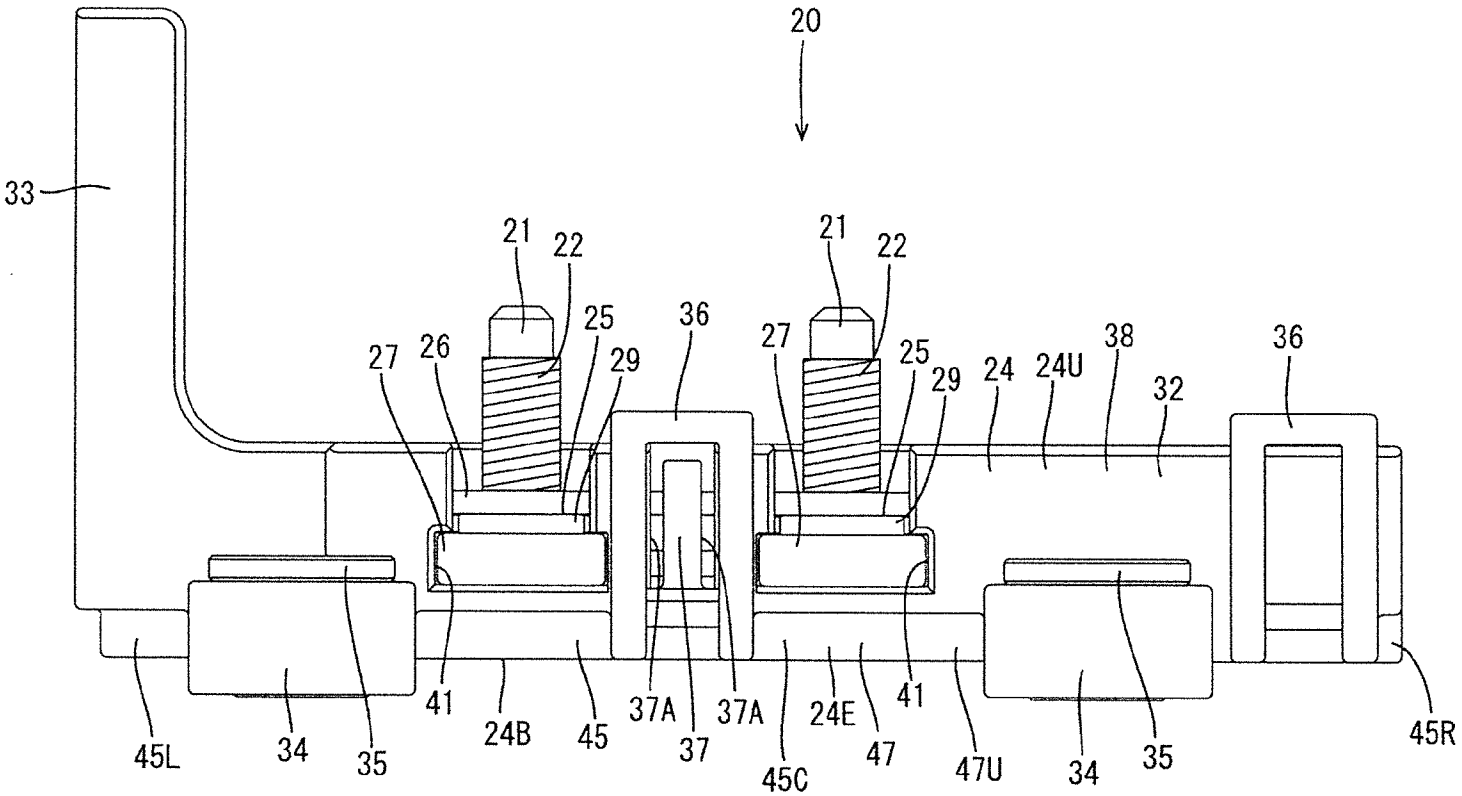
FIG. 6 is a bottom view of the terminal block.

The housing 24 is substantially L-shaped when viewed vertically, and includes a main body 32 that is long and narrow in the lateral direction and a vertical portion 33 extending substantially vertically up on the left side of the main body 32 in a longitudinal direction (see FIG. 6). The second terminal fitting 12 extends along the main body 32 and the vertical portion 33 on the left side of the housing 24. The first terminal fitting 11 extends along the main body 32 on the right side of the housing 24 (see FIG. 8).

Figure 7:
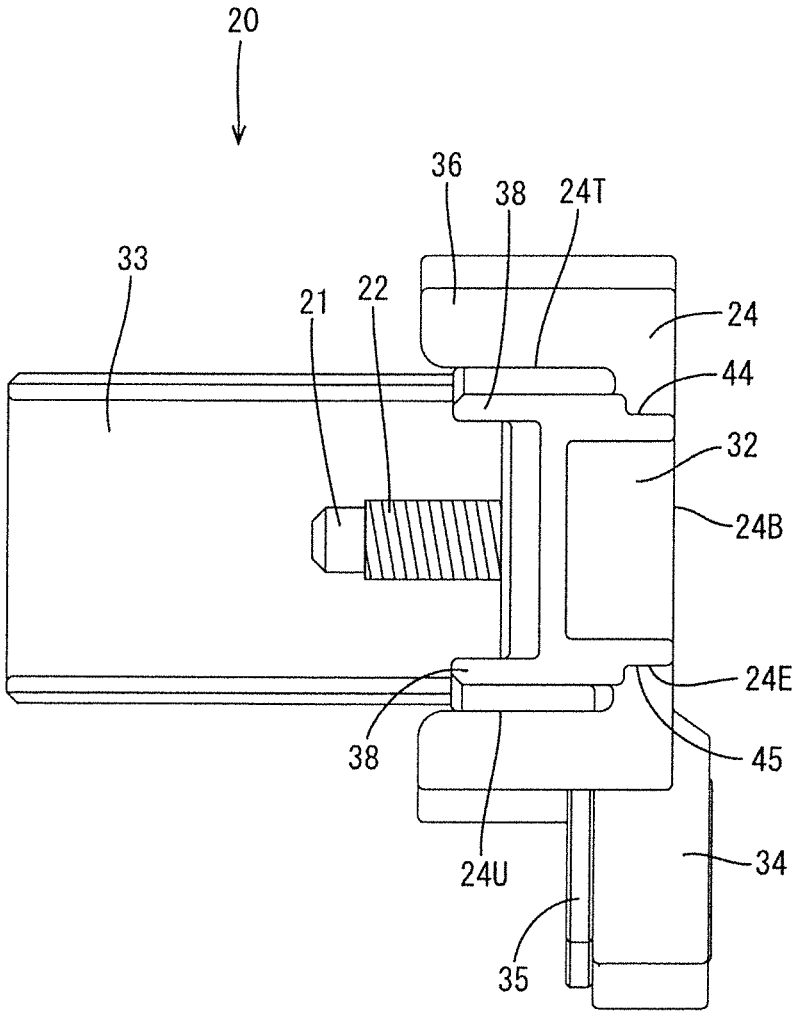
FIG. 7 is a side view of the terminal block.

Two mounting flanges 34 are provided in the housing 24 (see FIG. 1). The mounting flanges 34 are provided on a lower end part of the housing 24 and project down from a lower surface 24U of the housing 24 (see FIG. 7). Collars 35 made of metal are fixed to the mounting flanges 34 by press-fitting or insert molding, and the terminal block 20 is mounted and fixed to the body of the unillustrated vehicle by inserting unillustrated mounting bolts into the collars 35 and tightening them into bolt holes of the body. The mounting flanges 34 project slightly back from a rear surface 24B of the housing 24, so that the rear surface 24B of the housing 24 is not in contact with the body when the terminal block 20 is mounted on the body.

The housing 24 includes cover locks 36 for holding the protection cover 50 in a mounted state (see FIGS. 5 and 6). The cover locks 36 are substantially U-shaped and cover locks 36 are provided on the outer periphery of the housing 24. Specifically, upper and lower cover locks 36 are provided substantially in a lateral center of the housing 24 and upper and lower cover locks 36 are provided on a right end part of the housing 24. Note that the cover locks 36 provided substantially in the center of the housing 24 function to protect lock pieces 37 by being located outside the lock pieces 37.

As shown in FIGS. 5 and 6, the housing 24 includes standing wall portions 38 standing toward a front side along the upper and lower edges of the housing 24. The standing wall portions 38 are substantially entirely provided from the vertical portion 33 to the main body portion 32. The standing wall portions 38 have a substantially constant height and the distal ends (front ends) of the standing wall portions 38 of the main body portion 32 are located substantially at the same height as substantially axial centers of the stud bolts 21.

As shown in FIG. 5, the housing 24 includes a mounting portion 39 in which the connection plate 26 is to be mounted. The mounting portion 39 is provided in a longitudinal central part of the main body portion 32 and somewhat displaced to the left side. The mounting portion 39 is a recess having a substantially rectangular shape in conformity with the outer shape of the connection plate 26 and open toward the front side. The mounting portion 39 is formed to have a slightly larger width (vertical dimension) than other parts of the main body portion 32 and steps are formed at parts of the standing wall portions 38 located at corners of the mounting portion 39.

As shown in FIGS. 5 and 6, the lock pieces 37 for preventing the detachment of the connection plate 26 by being locked to a peripheral edge part of the connection plate 26 mounted into the mounting portion 39 are provided on parts of the standing wall portions 38 surrounding the mounting portion 39. A pair of upper and lower lock pieces 37 are provided substantially in a longitudinal central part of the mounting portion 39. Each lock piece 37 is divided from the standing wall portion 38 by a pair of long and narrow slits 37A extending in a front-back direction.

As shown in FIG. 8, the housing 24 is formed with bolt accommodating portions 41 for accommodating the head portions 27 of the stud bolts 21 inside. The bolt accommodating portions 41 are provided on a rear side of the mounting portion 39, the head portions 27 of the stud bolts 21 are accommodated in the bolt accommodating portions 41 and the shaft portions 22 project into the mounting portion 39.

The bolt accommodating portion 41 is formed into a rectangular box shape in conformity with the outer shape of the head portion 27 of the stud bolt 21. A fastening seat fitting portion 42 cut into a substantially semicircular shape in conformity with the outer shape of the fastening seat 29 is formed on a front wall of the bolt accommodating portion 41. The bolt accommodating portion 41 and the fastening seat fitting portion 42 are open downward and the head portion 27 of the stud bolt 21 can be accommodated thereinto from below. A lateral dimension of a lower opening of the fastening seat fitting portion 42 is smaller than an outer diameter of the fastening seat 29 (see FIG. 10). This causes the fastening seat 29 to be retained and the stud bolt 21 to be held in the bolt accommodating portion 41. Note that the front surface (seating surface 25) of the fastening seat 29 fitted into the fastening seat fitting portion 42 is located slightly more forward than the front wall of the bolt accommodating portion 41 and is directly connected to the rear surface of the connection plate 26 mounted in the mounting portion 39 by metal to metal touch.

Figure 11:
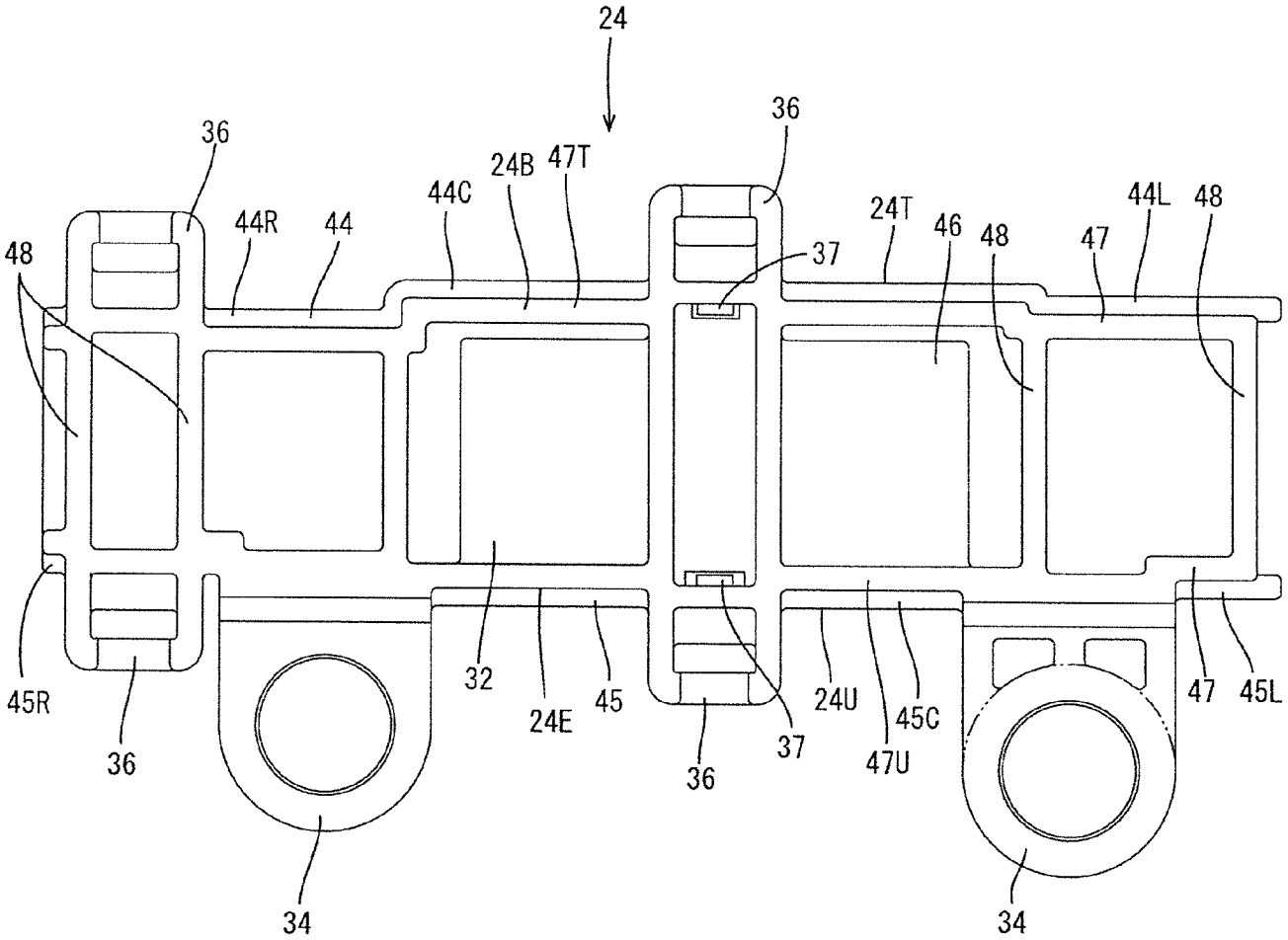
FIG. 11 is a rear view of a housing.

As shown in FIG. 11, recesses (recess provided along the upper end edge of the housing 24 is referred to as an upper recess 44 and that provided along the lower end edge is referred to as a lower recess 45) are provided on the rear surface 24B of the housing 24 along the upper and lower end edges of the rear surface 24B. The upper and lower recesses 44, 45 respectively extend in a horizontal direction in the state where the terminal block 20 is fixed to the body and are substantially parallel to each other.

The upper recess 44 has a substantially constant width (vertical dimension) as a whole. As shown in FIG. 4, the width of the upper recess 44 is equal to the thickness of an upper surface cover portion 51 of the protection cover 50 to be described later and that of the lower recess 45 is equal to the thickness of a lower surface cover portion 52 of the protection cover 50 to be described later. Further, the depths (dimensions in the front-back direction) of the upper and lower recesses 44, 45 are larger than the widths thereof. Note that parts of the left end (right end in FIG. 11) of the main body portion 32 of the housing 24 where the upper and lower recesses 44, 45 are provided project further leftward than a part between these parts.

The upper recess 44 is provided entirely from the left end to the right end of the upper end edge of the main body portion 32 of the housing 24 except at parts where the cover locks 36 are provided. A central part 44C of the upper recess 44 is displaced upwardly from the other parts in conformity with the shape of the mounting portion 39, and vertical steps are formed at parts of the central part 44C coupled to a left end part 44L and a right end part 44R of the upper recess 44. Note that the left end part 44L of the upper recess 44 is located above the right end part 44R.

The lower recess 45 is provided entirely from the left end to the right end of the lower end edge of the main body portion 32 of the housing 24 except at parts where the cover locks 36 and the mounting flanges 34 are provided. A central part 45C (part located between the pair of mounting flanges 34 and corresponding to the mounting portion 39) of the lower recess 45 is displaced downwardly from a left end part 45L and a right end part 45R of the lower recess 45. Note that the right end part 45R of the upper recess 45 is located above the left end part 45L.

A pair of upper and lower horizontal ribs 47 extending in the horizontal direction are formed on the rear surface 24B of the housing 24. The horizontal ribs 47 includes an upper horizontal rib 47T located on an upper end side of the housing 24 and constituting the upper recess 44 and a lower horizontal rib 47U located on a lower end side of the housing 24 and constituting the lower recess 45. The upper horizontal rib 47T is formed at a position separated downwardly from the upper end of the housing 24 by the width of the upper recess 44, and the lower horizontal rib 47U is formed at a position separated upwardly from the lower end of the housing 24 by the width of the lower recess 45. The upper horizontal rib 47T is connected to the cover locks 36 provided on an upper side of the housing 24 and the lower horizontal rib 47U are connected to the cover locks 36 and the mounting flanges 34 provided on a lower side of the housing 24.

A plurality of vertical ribs 48 extending in the vertical direction are formed on the rear surface 24B of the housing 24. A pair of vertical ribs 48 provided between the cover lock 36 provided on the upper side of the housing 24 and the cover lock 36 provided on the lower side are respectively connected to the upper and lower cover locks 36. Further, one vertical rib 48 is provided at each of positions connected to the upper sides of the respective mounting flanges 34 and a left end part of the housing 24.

The horizontal ribs 47 and the vertical ribs 48 are coupled substantially perpendicularly to each other and parts of the rear surface 24B of the housing 24 enclosed by the horizontal ribs 47 and the vertical ribs 48 serve as thinner portions 46.

The protection cover 50 collectively covers the vertical portion 33 and the main body 32 of the housing 24 and is dimensioned to extend from one end of the vertical portion 33 to one end of the main body 32. The protection cover 50 includes the upper surface cover portion 51 for covering an upper surface 24T of the housing 24, the lower surface cover 52 for covering the lower surface 24U of the housing 24 and a front surface cover 53 for covering a front surface side of the housing 24.

As shown in FIG. 4, the front surface cover 53 is formed into a cap shape capable of accommodating the shafts 22 of the stud bolts 21 inside and includes a front plate 53S to be arranged at a front side of the shafts 22 of the stud bolts 21, an upper plate 53T to be arranged above the shafts 22 of the stud bolts 21 and a lower plate 53U to be arranged below the shafts 22 of the stud bolts 21 when the protection cover 50 is assembled with the terminal block 20. The front plate 53S is arranged so that a plate surface thereof is substantially perpendicular to the shafts 22 of the stud bolts 21, and the upper and lower plates 53T, 53U are formed to extend back from the upper and lower ends of the front plate 53S substantially in parallel. The rear ends of the upper and lower plates 53T and 53U are in contact with the distal ends of the standing walls 38 of the housing 24 when the protection cover 50 is assembled with the terminal block 20.

Figure 2:
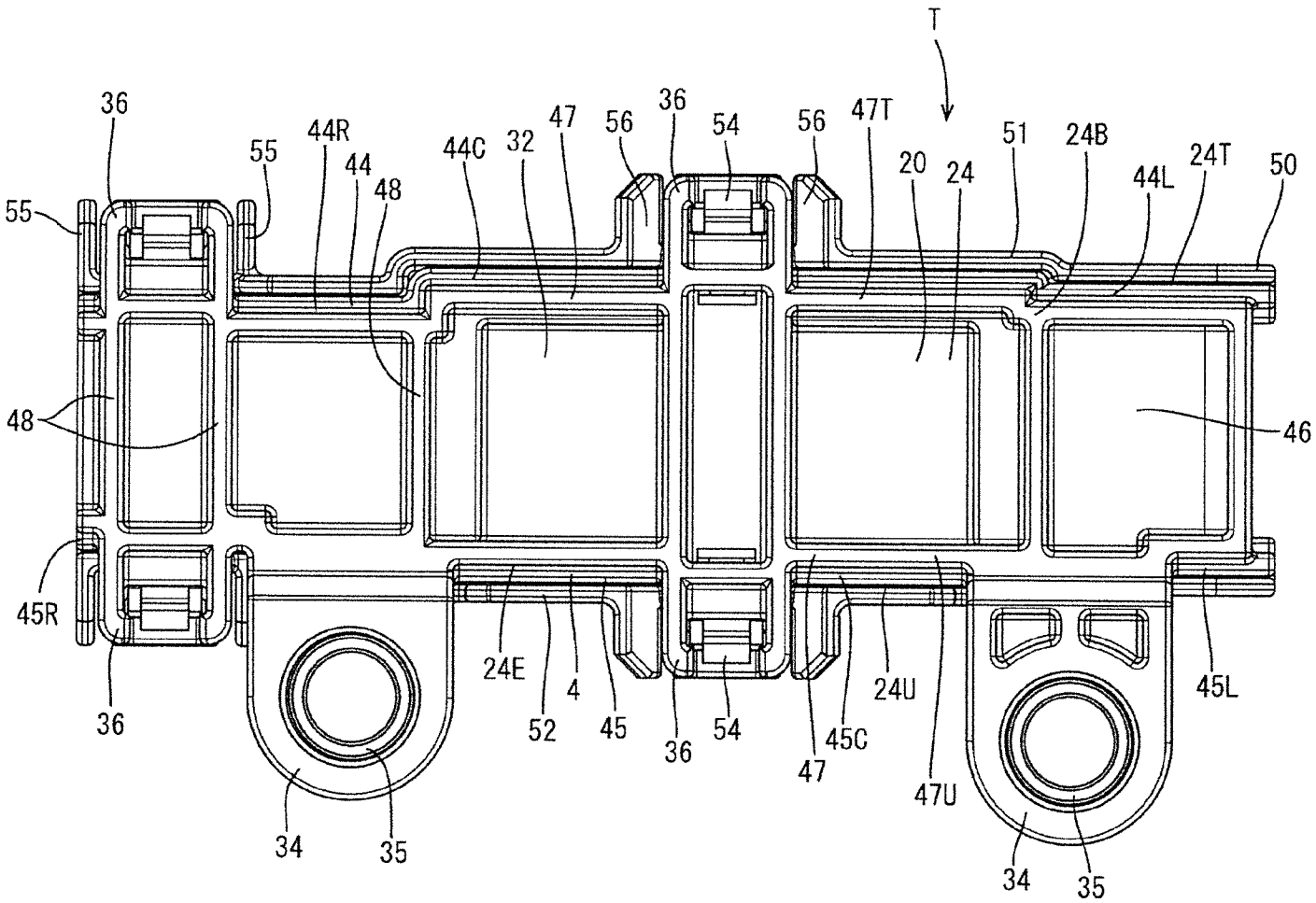
FIG. 2 is a rear view of the terminal block with the protection cover.

The upper surface cover 51 is connected to the upper plate 53T of the front surface cover 53. The upper surface cover 51 is formed to be slightly displaced up from the upper plate 53T and has a plate surface substantially parallel to the upper plate 53T. The upper surface cover 51 is shaped in conformity with the upper surface 24T of the housing 24 and a part thereof arranged above the mounting portion 39 is slightly displaced up in conformity with the shape of the mounting portion 39 (see FIG. 2). The upper surface cover 51 substantially entirely covers the upper surface 24T of the housing 24, and the outer edge (edge opposite to the front surface cover portion 53) of the upper surface cover 51 and the rear surface 24B of the housing 24 are arranged so that the positions thereof in the front-back direction are aligned (see FIG. 4).

A step is formed between an outer edge 51E (part facing the upper recess 44) of the upper surface cover 51 and the housing 24 when the protection cover 50 is mounted on the terminal block 20. The outer edge 51E of the upper surface cover 51 is separated from the upper surface 24T of the housing 24 by the width of the upper recess 44 and covers a part of the upper surface 24T of the housing 24 where the upper recess 44 is formed. A part of the upper surface cover 51 more backward than the outer edge 51E (closer to the front surface cover 53) defines an upper surface proximate portion 51P to be arranged proximate to the upper surface 24T of the housing 24 with a very small clearance formed therebetween. Specifically, a clearance larger than the one between the upper surface proximate portion 51P and the upper surface 24T of the housing 24 is formed below the outer edge 51E of the upper surface cover 51.

The lower surface cover 52 is continuous with the lower plate 53U of the front surface cover 53. The lower surface cover 52 is displaced slightly down from the lower plate 53U and has a plate surface substantially parallel to the lower plate 53U. The lower surface cover 52 extends along the lower surface 24U of the housing 24 and a part below the mounting portion 39 is displaced slightly down in conformity with the shape of the mounting portion 39 (see FIG. 2). The lower surface cover 52 covers the lower surface 24U of the housing 24 substantially entirely and the outer edge (edge opposite to the front surface cover 53) of the lower surface cover 52 and the rear surface 24B of the housing 24 are aligned in the front-back direction (see FIG. 4).

A step is formed between an outer edge 52E (part facing the lower recess 45) of the lower surface cover 52 and the housing 24 when the protection cover 50 is mounted on the terminal block 20. The outer edge 52E of the lower surface cover 52 is separated from the lower surface 24U of the housing 24 by the width of the lower recess 45 and covers a part of the lower surface 24U of the housing 24 where the lower recess 45 is formed. A part of the lower surface cover 52 more backward than the outer edge 52E (closer to the front surface cover 53) defines a lower surface proximate portion 52P to be arranged proximate to the lower surface 24U of the housing 24 with a very small clearance formed therebetween. Specifically, a clearance larger than the one between the lower surface proximate portion 52P and the lower surface 24U of the housing 24 is formed below an outer edge 24E of the lower surface cover 52 of the housing 24.

Figure 3:
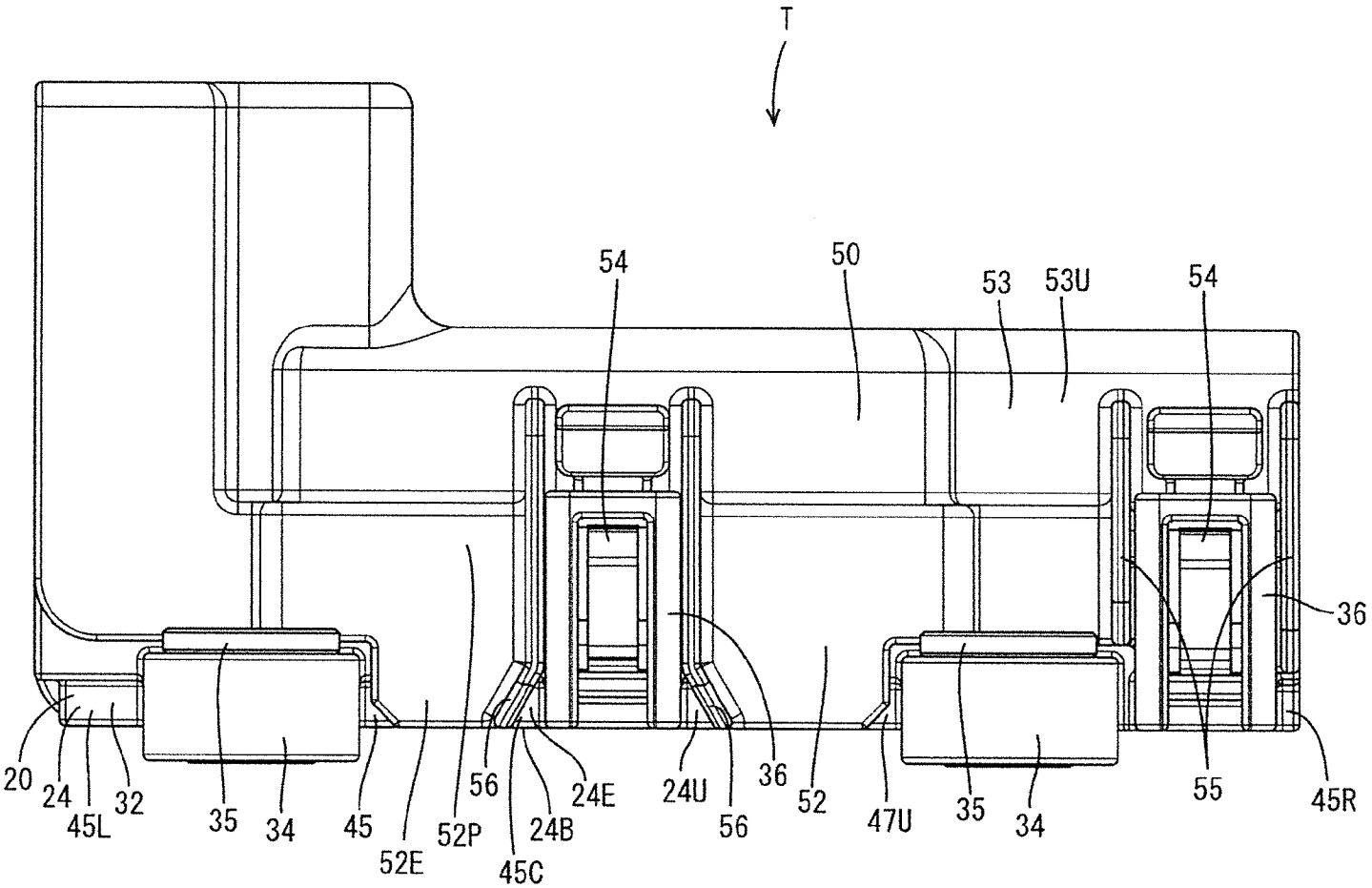
FIG. 3 is a bottom view of the terminal block with the protection cover.

As shown in FIGS. 3 and 6, locks 54 to be locked to the cover locks 36 of the housing 24 are formed at positions corresponding to the cover locks 36 on the upper surface cover 51 and the lower surface cover 52. Further, each of the upper and lower surface covers 51, 52 includes pairs of side walls 55 standing at left and right sides of the locks 54. When the protection cover 50 is assembled with the terminal block 20, each pair of side walls 55 stands with the cover lock 36 of the housing 24 located therebetween. The side walls 55 on the upper surface cover 51 stand vertically up from the upper surface cover 51 and those provided on the lower surface cover 52 hang vertically down from the lower surface cover 52.

The pairs of side walls 55 located in the center of the protection cover 50 are formed with guides 56 for guiding the cover locks 36 of the housing 24 (see FIG. 3). The guides 56 are provided at rear end parts of the pair of side walls 55 and obliquely formed so that a distance between the facing side walls 55 is widened toward the rear end. The cover lock 36 of the housing 24 is guided by the inclinations of the guides 56.

Any liquid adhering to the upper surface of the protection cover 50 reaches the outer edge of the upper surface cover 51 falls down from that outer edge due to vibration or the like and eventually is discharged to a side below the terminal block 20. Here, if there is only a small clearance between the outer edge of the upper surface cover and the upper surface of the housing (the entire upper surface cover is proximate to the upper surface of the housing), the liquid that reaches the outer edge of the upper surface cover may penetrate into the small clearance by a capillary phenomenon and eventually reach the electrically connected parts of the terminal block and the first and second terminal fittings. However, according to this embodiment, the liquid having reached the outer edge of the upper surface cover 51 falls down from that outer edge. Thus, a situation where liquid having reached such a small clearance penetrates into the inside can be prevented.

Further, any liquid that adheres to the rear surface 24B of the housing 24 and eventually reaches the lower end (lower edge of the lower horizontal rib 47U) falls down from that lower edge due to vibration and is discharged to the side below the terminal block 20. Here, if there is only a small clearance between the lower end of the housing and the lower surface cover (the entire lower surface cover is proximate to the lower surface of the housing), the liquid that reaches the lower end of the housing may penetrate into the small clearance by a capillary phenomenon and eventually reach the electrically connected parts of the terminal block and the first and second terminal fittings. However, according to this embodiment, liquid that reaches the lower end of the housing 24 falls down from that lower end. Thus, a situation where liquid having reached such a small clearance penetrates into the inside can be prevented.

As described above, this embodiment includes the terminal block 20 to which the first and second terminal fittings 11, 12 fixed to the ends of the wires 10 are electrically connected by bolting, and the protection cover 50 covers the electrically connected parts with the first and second terminal fittings 11, 12 by being assembled with the terminal block 20. The first and second terminal fittings 11, 12 are connected to the front surface side of the housing 24 of the terminal block 20. The protection cover 50 covers the front surface side of the housing 24 and includes the upper surface cover 51 for covering the upper surface 24T of the housing 24. The upper surface cover 51 includes the upper surface proximate portion 51P to be arranged proximate to the upper surface 24T of the housing 24. By forming the step between the outer edge 51E of the upper surface cover 51 and the housing 24, the upper surface proximate portion 51P is located more backward than the outer edge 51E of the upper surface cover 51, and the clearance larger than the one between the upper surface proximate portion 51P and the upper surface 24T of the housing 24 is formed below the outer edge 51E of the upper surface cover 51. Since this causes liquid that flows along the upper surface of the upper surface cover 51 of the protection cover 50 and reaches the outer edge of that upper surface to fall down without reaching the upper surface proximate portion 51P, the penetration of the liquid through a small clearance between the protection cover 50 and the terminal block 20 can be prevented.

The protection cover 50 includes the lower surface cover 52 for covering the lower surface 24U of the housing 24 and the lower surface cover 52 includes the lower surface proximate portion 52P to be arranged proximate to the lower surface 24U of the housing 24. By forming the step between the outer edge 52E of the lower surface cover 52 and the housing 24, the lower surface proximate portion 52P is located more backward than the outer edge 24E of the lower surface 24U of the housing 24 and the clearance larger than the one between the lower surface proximate portion 52P and the lower surface 24U of the housing 24 is formed below the outer edge 24E of the lower surface 24U of the housing 24. Since this causes liquid having flowed along the rear surface 24B (outer surface) of the housing 24 and reached the lower edge of the rear surface 24B (outer edge of the lower surface 24U of the housing 24) to fall down without reaching the lower surface proximate portion 52P, the penetration of the liquid through the small clearance between the protection cover 50 and the terminal block 20 can be prevented.

Further, the steps are provided by forming the upper recess 44 and the lower recess 45 on the housing 24. Here, in the case of providing the step, for example, by causing the outer edge of the protection cover to project toward a side away from the housing, it leads to the enlargement of the terminal block with the protection cover and a change in the outer shape of the terminal block with the protection cover. However, by forming the upper recess 44 and the lower recess 45 on the housing 24, such enlargement and shape change can be avoided.

The invention is not limited to the above described and illustrated embodiment. For example, the following embodiments are also included in the technical scope of the present invention.

The steps are provided by forming the upper and lower recesses 44, 45 on the housing 24 in the above embodiment. However, there is no limitation to this and steps may be provided, for example, by forming the protection cover such that the outer edge thereof projects toward the side away from the housing.

The step is provided by forming the upper recess 44 on the housing 24 on the side of the upper surface 24T of the housing 24 in the above embodiment. However, there is no limitation to this and a step may be provided, for example, by forming the protection cover so that the outer edge of the upper surface cover projects farther back than the rear surface of the housing (rear end of the upper surface of the housing).

The step is provided by forming the lower recess 45 on the housing 24 on the side of the lower surface 24U of the housing 24 in the above embodiment. However, there is no limitation to this and a step may be provided, for example, by forming the protection cover so that the outer edge of the lower surface cover is retracted toward the front side from the rear surface of the housing (outer edge of the lower surface of the housing is exposed downward).

The steps between the protection cover 50 and the housing 24 are provided on both upper and lower sides of the housing 24 in the above embodiment. However, there is no limitation to this and the step between the protection cover and the housing may be provided only on the upper side.

LIST OF REFERENCE SIGNS

T . . . terminal block with protection cover
10 . . . wire
11 . . . first terminal fitting
12 . . . second terminal fitting
20 . . . terminal block
21 . . . stud bolt (fastening member)
24 . . . housing
24E . . . outer edge of lower surface of housing
24T . . . upper surface of housing
24U . . . lower surface of housing
44 . . . upper recess
45 . . . lower recess
50 . . . protection cover
51 . . . upper surface cover
51E . . . outer edge of upper surface cover
51P . . . upper surface proximate portion
52 . . . lower surface cover
52E . . . outer edge of lower surface cover
52P . . . lower surface proximate portion

What is claimed is:

1. A terminal block with a protection cover, comprising a terminal block to which a terminal fitting fixed to an end of a wire is to be electrically connected by bolting and a protection cover that covers an electrically connected part with the terminal fitting by being assembled with the terminal block, wherein:

the terminal block includes a housing to which the terminal fitting is to be bolt-fastened and which holds a fastening member;

the fastening member is provided on a side surface side of the housing;

the protection cover covers the side surface of the housing and includes an upper surface cover for covering an upper surface of the housing;

the upper surface cover includes an upper surface proximate portion to be arranged proximate to the upper surface of the housing; and a clearance larger than the a clearance between the upper surface proximate portion and the upper surface of the housing is formed below an outer edge of the upper surface cover by forming a step between the outer edge of the upper surface cover and the housing.

2. The terminal block with the protection cover of claim 1, wherein:

the protection cover includes a lower surface cover for covering a lower surface of the housing;

the lower surface cover includes a lower surface proximate portion to be arranged proximate to the lower surface of the housing; and a clearance larger than a clearance between the lower surface proximate portion and the lower surface of the housing is formed below an outer edge of the lower surface of the housing by forming a step between the outer edge of the lower surface cover and the housing.

3. The terminal block with the protection cover of claim 2, wherein:

the step is formed by forming a recess on the housing.

4. The terminal block with the protection cover of claim 1, wherein:

the step is formed by forming a recess on the housing.

* * * * *